United States Patent [19]

Susa et al.

[11] Patent Number: 5,052,571

[45] Date of Patent: Oct. 1, 1991

[54] AUTOMOTIVE RADIATOR CAP

[75] Inventors: Sumio Susa, Anjo; Toshio Nagara, Toyoda; Sunao Fukuda, Oobu; Seiichi Kato, Toyoake; Satomi Muto, Nagoya, all of Japan

[73] Assignee: Nippondenso Co., Ltd., Kariya, Japan

[21] Appl. No.: 363,375

[22] Filed: Jun. 2, 1989

Related U.S. Application Data

[63] Continuation of Ser. No. 39,283, Apr. 17, 1987, abandoned.

[30] Foreign Application Priority Data

| | | | |
|---|---|---|---|
| Apr. 18, 1986 | [JP] | Japan | 61-90994 |
| Jul. 21, 1986 | [JP] | Japan | 61-171294 |
| Jul. 21, 1986 | [JP] | Japan | 61-171295 |
| Oct. 8, 1986 | [JP] | Japan | 61-239976 |

[51] Int. Cl.[5] ..... B65D 51/16

[52] U.S. Cl. ..... 220/203; 220/204; 220/DIG. 32

[58] Field of Search ..... 220/202, 203, 204, 209, 220/DIG. 32

[56] References Cited

U.S. PATENT DOCUMENTS

| | | | |
|---|---|---|---|
| 2,164,450 | 7/1939 | Eshbaugh et al. | 220/DIG. 32 X |
| 2,406,502 | 8/1946 | Lines | 220/203 |
| 2,649,986 | 8/1953 | Konchan | 220/203 |
| 3,053,408 | 9/1962 | Rodgers | 220/203 |
| 3,164,288 | 1/1965 | Boomgaard | 220/203 |
| 3,189,213 | 6/1965 | Nimmo | 220/203 |
| 3,203,578 | 8/1965 | Previte | 220/203 |
| 3,381,846 | 5/1968 | Lee | 220/203 |
| 3,910,451 | 10/1975 | Tusing | 220/203 |
| 4,136,795 | 1/1979 | Crute et al. | 220/203 |
| 4,185,751 | 1/1980 | Moore et al. | 220/203 |
| 4,196,822 | 4/1980 | Avrea | 220/203 |
| 4,241,845 | 12/1980 | Daly et al. | 220/203 |
| 4,489,883 | 12/1984 | Anderson | 220/DIG. 32 X |
| 4,498,599 | 2/1985 | Avrea | 220/203 |

*Primary Examiner*—Stephen Marcus
*Assistant Examiner*—Nova Stucker
*Attorney, Agent, or Firm*—Cushman, Darby & Cushman

[57] ABSTRACT

A radiator cap sets on a filler neck of an automotive radiator tank. The radiator cap has an inner cap rotatably connected with an outer cap, a pressure valve operatively connected with the inner cap in such a manner that the pressure valve can move vertically so that the pressure valve opens the filler neck when the pressure within the radiator tank increases up to a predetermined pressure. The radiator cap further includes a coil spring provided between the inner cap and the pressure valve for biasing the pressure valve toward the filler neck. Since the connecting point between the coil spring and the pressure valve is lower than the connecting point between a sealing portion of the pressure valve and the filler neck, a rotating moment which returns the pressure valve horizontally is generated when the pressure valve is inclined, preventing the pressure valve from inclining. The pressure valve of the present invention can maintain its position horizontally and can open the filler neck always at the predetermined pressure.

7 Claims, 7 Drawing Sheets

AUTOMOTIVE RADIATOR CAP

This is a continuation of application Ser. No. 07/039,283, filed Apr. 17, 1987, which was abandoned upon the filing hereof.

FIELD OF THE INVENTION

The present invention relates to an automotive radiator cap detachably connected with a filler neck of an automotive radiator.

BACKGROUND OF THE INVENTION

A conventional type of automotive radiator is described in Japanese patent laid-open publication 55-41391 and 58-1729419 and has a coil spring for biasing a pressure valve in order to close the valve. The pressure valve of the conventional type of the automotive radiator cap, however, has a disadvantage that the pressure valve cannot smoothly sit on a seal portion.

The reason why the pressure valve of the conventional type radiator cap cannot sit smoothly is explained hereinafter with reference to FIG. 5. Numeral 501 in FIG. 5 shows a top surface of a filler neck, numeral 503 shows a pressure valve and letter $F_0$ shows a closing force of the coil spring.

Since the coil spring is contacted with the pressure valve 503 at the portion which is higher than the top surface 501 of the filler neck, and since the closing force $F_0$ forces a top surface 505 of the pressure valve 503 vertically, the force $F_1$ which has an orientation parallel with the top surface 505 of the pressure valve 503 occurs when the pressure valve 503 is inclined as shown in FIG. 5. The force $F_1$ is calculated as next formula $$F_1 = F_0 \times \sin\theta$$

wherein $\theta$ means opening angle of the pressure valve 503 and D shows the distance between the top surface 505 of the pressure valve 503 and a sealing portion 507 of the pressure valve 503. The force $F_1$ causes a rotating moment $M_0$ which is calculated with the next formula $$M_0 = F_1 \times D.$$

Therefore the moment $M_0$ causes the pressure valve 503 to rotate clockwise as shown by arrow R in FIG. 5.

Therefore, the force $F_1$ makes the pressure valve 503 open even though the coil spring biases the pressure valve 503 to the closing position. Accordingly, the force $F_1$ makes it hard for the pressure valve to sit smoothly on the filler neck 501.

Another type of the conventional automotive radiator cap is described in U.S. Pat. No. 3,265,048 and has also the coil spring biasing the pressure valve toward the filler neck in order to open the filler neck when the pressure within a radiator tank increases to a predetermined pressure. Since the pressure valve increases the boiling temperature point of the coolant within the radiator tank, the pressure valve does not open the filler neck when the temperature of the coolant within the radiator tank increases to its boiling point under normal atmospheric pressure. The pressure valve opens the filler neck when the temperature of the coolant increases to greater than the boiling point under normal atmospheric pressure and the pressure of the coolant increases to greater than a predetermined value.

The pressure valve has a connecting hole at the center portion thereof and has a pressure modulating valve provided within the connecting hole so that the pressure modulating valve opens or shuts the connecting hole.

The pressure modulating valve normally opens the connecting hole by its weight so that the pressure within the radiator tank can be maintained under the normal atmospheric pressure during the condition when the pressure within the radiator tank is under the predetermined pressure under which the coolant is boiling. When the coolant within the radiator tank vaporizes and the pressure of the steam increases up to the predetermined pressure, the pressure of the steam moves the pressure modulating valve upwardly so that the pressure modulating valve shuts the connecting hole.

The pressure within the radiator tank normally increases gradually due to the operating period of the automotive engine. The pressure within the radiator tank, however, increases rapidly under special circumstances such as the engine is racing.

Under such special circumstances the conventional radiator cap has a serious disadvantage, namely the pressure modulating valve cannot open the connecting hole after the pressure modulating valve is closed by the rapidly increasing pressure. Since the pressure within radiator tank is normally under air pressure, the pressure modulating valve is forced to its closing position by the normal pressure within the radiator tank after the pressure modulating valve is closed by the rapidly increasing pressure within the radiator tank.

Accordingly, the rapidly increasing pressure is held within the radiator tank by the pressure modulating valve, and such pressure can cause some pressure damage to the tube.

Another type of conventional automotive radiator has a cap as shown in FIG. 12. This conventional cap has a pressure valve body 804 which seals a filler neck and a pressure modulating valve 806 which opens and shuts the connecting hold 805 provided in the pressure valve body 804. Since the pressure modulating valve 806 is biased by a spring 808 in order to close the connecting hole 805, the pressure modulating valve cannot be operated frequently and the travelling distance of the pressure modulating valve when the pressure modulating valve opens the connecting hole is slight.

Therefore, this conventional pressure modulating valve has the disadvantage that objects located between the pressure modulating valve 806 and the connecting hole 805 are difficult to remove after such objects are adhered between the pressure modulating valve 806 and the connecting hole 805.

SUMMARY OF THE INVENTION

The first object of the present invention is to solve the disadvantage that the pressure valve does not sit smoothly when the pressure valve is inclined. Namely the first object of the present invention is to allow the pressure valve to sit smoothly on the sealing portion.

The second object of the present invention is to solve the disadvantage that the pressure modulating valve closes the connecting hole before the pressure within the radiator tank increases up to the predetermined pressure value. Namely the second object of the present invention is to provide a pressure modulating valve which can effectively open the connecting hole at the predetermined pressure.

The third object of the present invention is to solve the disadvantage that objects adhered etween the pressure modulating valve and the connecting hole are hard to remove. Namely, the third object of the present invention is to provide a pressure modulating valve which can effectively remove any objects.

In order to attain the first object, the present invention is formed so that the contacting point at which the coil spring contacts on the pressure valve is at a point lower than the contacting point between the pressure valve and seal portion.

Since the contacting point between the coil spring and the pressure valve 603 is lower than the contacting point between the pressure valve 603 and the seal portion 607 as shown in FIG. 6 which shows the pressure valve and the end portion of the filler neck, the holding force $F_0$ is added onto the pressure valve 603 at the point which is lower than the seal portion. Since the holding force $F_0$ has a force $F_1$ with an orientation parallel with the upper surface 605 of the pressure valve 603, the rotating moment $M_1$ which is calculated by the formula $M_1 = F_1 \times D_1$ is generated. Since the orientation of the rotating moment $M_1$ (which is shown by arrow P) makes the pressure valve 603 shut the connecting hole, the pressure valve 603 can sit on the seal portion smoothly. $D_1$ represents the distance between the upper surface 605 of the pressure valve 603 and the seal surface 607 of the pressure valve 603.

Accordingly, since the first embodiment of the present invention has the pressure valve which can sit smoothly on the sealing portion, the pressure valve of the first invention can sit on the seal portion of the filler neck at the same portion, namely the seal member provided on the pressure valve is contacted with the sealing portion of the filler neck at the same portion thereof. Since the seal member has a tendency to make a permanent deformation, such a permanent deformation makes the coolant within the radiator tank escape therethrough if the seal member has changed its position. The first invention of present invention, however, will prevent such escape through the permanent deformation of the seal member, because the seal member is always set on the seal portion at the same position. The permanent deformation of the sealing member prevents any passage between the seal member and the seal portion of the filler neck.

In order to attain the second object of the present embodiment, the second invention of the present invention employs a spring which biases the pressure modulating valve toward the closing position thereof. Accordingly, the second aspect of the present invention can release the pressure within the radiator tank even though the pressure within the radiator increases rapidly and then reduces down to the predetermined pressure.

Since high pressure should not remain within the radiator tank, the radiator tank and the tube of the second aspect of the present invention are prevented from being damaged by the pressure. Accordingly the deterioration of the radiator tank and the tube can be reduced.

The third embodiment of the present invention employs a pressure modulating valve which is made of thermally deformable material which deforms in shape due to the temperature within the radiator tank, so that the pressure modulating valve of the third embodiment of the present invention can release the connecting hole when the temperature within the tank is lower than the predetermined temperature and closes the connecting hole when the temperature within the radiator tank is higher than the predetermined temperature. Therefore, the coolant within the radiator tank can be released to the outer atmosphere through the connecting hole when the temperature of the source is lower than the predetermined temperature. The pressure within the radiator tank increases after the temperature of the coolant increases up to the predetermined temperature at which the pressure modulating valve closes the connecting hole.

Accordingly, since the pressure within the radiator tank can be released even though the pressure within the radiator tank is increasing rapidly, the pressure within the radiator tank can be maintained under the predetermined pressure value. Thus, the thickness of the radiator tank and the tube can be reduced in accordance with the present invention. Furthermore, since the pressure within the radiator tank of the present invention is prevented from varying frequently, the pressure damage to the radiator tank and the tube can be reduced.

In order to attain the third object, the fourth embodiment of the present invention employs a pressure modulating valve which is rotatably supported within the connecting hole and which has an impeller on a flange portion thereof. This pressure modulating valve can rotate within the connecting hole when the coolant within the radiator tank flows through the impeller. Namely, the flowing of the coolant makes the flange portion of the modulator of the pressure modulator valve rotate. Such rotation of the pressure modulating valve removes any objects adhered between the pressure modulating valve and the connecting hole.

DETAILED DESCRIPTION OF THE PREFERRED EMBODIMENT

Figure 1:
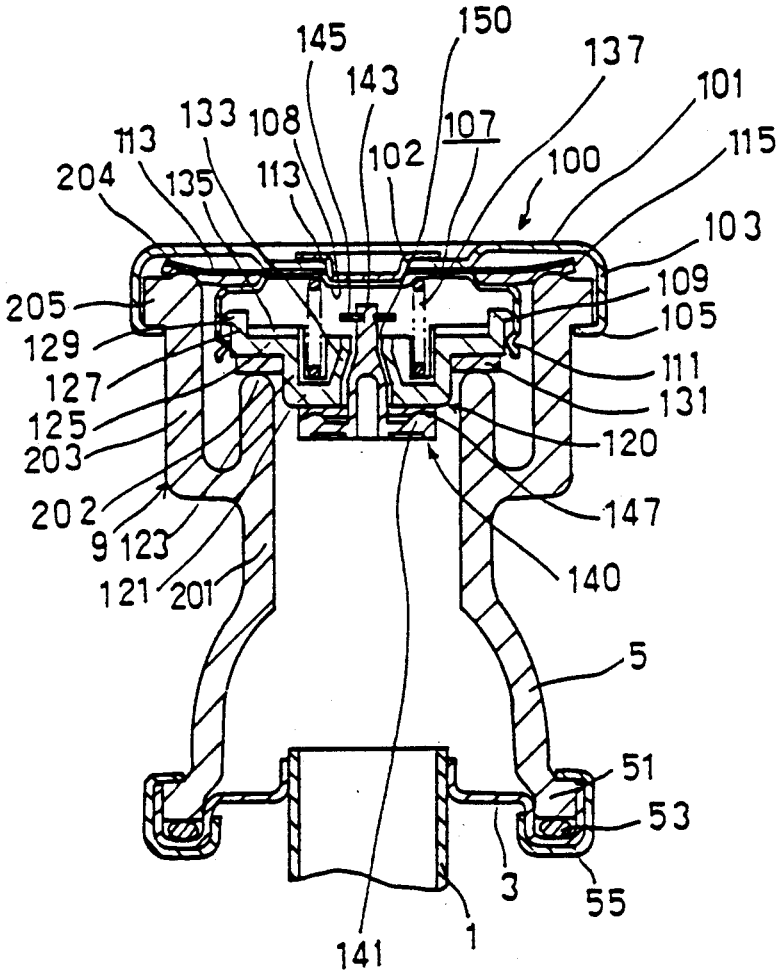
FIG. 1 is a sectional view taken along line I—I of FIG. 2 showing a radiator cap according to the first embodiment.
Figure 2:
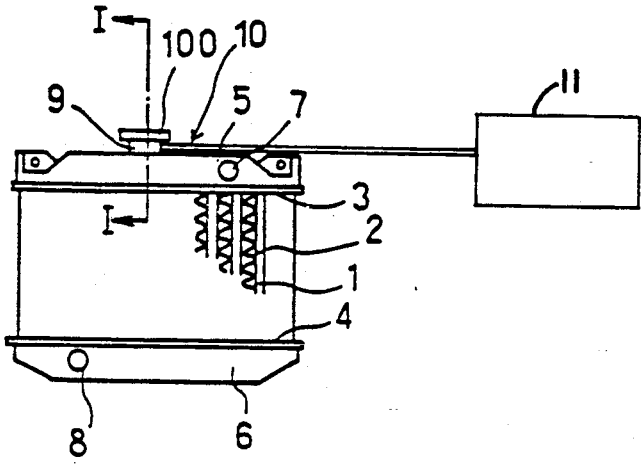
FIG. 2 is a front view of an automotive radiator.
Figure 3:
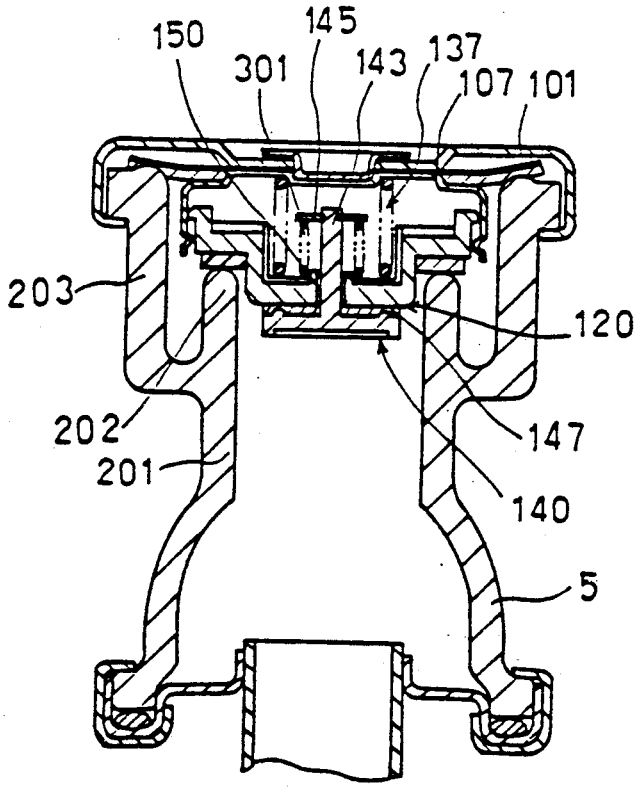
FIG. 3 is a sectional view showing a radiator cap according to the second embodiment.

An automotive radiator includes a plurality of tubes 1 with end plates 3 and 4 connected at both ends of the tubes 1, an upper tank 5 which connects with the upper end plate 3 and a lower tank 6 which connects with the lower end plate 4, as shown in FIG. 2. Corrugate fins 2 are provided between adjacent pairs of a plurality of tubes by welding so that the heat of the coolant passing through tube 1 is conducted to the corrugated fin in order to promote heat exchange.

An inlet pipe 7 through which coolant from an automotive engine (not shown) is introduced into the upper tank 5 and a filler neck 9 through which a coolant is replenished to the upper tank 5 are provided integrally on the upper tank 5. A connecting pipe 10 is provided on the filler neck 9 in order to connect the inside of the filler neck 9 to a reserve tank 11. A cap 100 is provided on the filler neck 9 in order to plug the filler neck 9.

An outlet pipe 8 through which the coolant in the lower tank 6 flows to the engine is provided on the lower tank 6.

The filler neck 9 has an inner tubular member 201 and an outer tubular member provided at the outside of the inner tubular member 201.

An inner seal portion 202 is provided at the opening end of the inner tubular member 201, and an outer seal portion 204 is provided at the opening end of the outer tubular member 203. The outer seal portion 204 is higher than the inner seal portion 202. A flange portion 205 is provided at the end portion of the outer tubular member in such a manner that the flange portion 205 extends radially outwardly.

The cap 100 has an outer cap member 101 the outer periphery of which extends downwardly to make a side wall 103, and the lower end of the side wall 103 extends radially inwardly to define a hook portion 105. The cap 100 is connected with the filler neck 9 when the hook portion 105 is contacted with the flange portion 205.

Since the flange portion 205 has a notch portion (not shown), the cap 100 can detach from the filler neck 9 when the hook portion 105 is disposed at the notch portion at the flange portion 205.

An inner cap member 107 is provided on the inner side of the outer cap member 101. The inner cap member has a wall portion 111 which is provided at the inner side of the side wall portion 109.

The outer cap member 101 has a port 102 at the center thereof, and the inner cap member 107 also has a concave portion 108 at the center thereof. The outer cap member 101 and the inner cap member 107 are connected to each other by a connecting plate 113 which is disposed at the concave portion 108 and the port 102.

The connecting plate 113 has a flange portion at the outer periphery thereof which connects around the port 102 of the outer cap member, the connecting plate 113 also has a center flat portion which is welded with the concave portion 108 of the inner cap member 107. In this manner the connecting plate 113 is fixed to the inner cap member 107. Since the outer cap member 101 is held between the flange portion of the connecting plate 113 and the inner cap member 107, the outer cap member 101 can rotate against the inner cap member 107 and the connecting plate 113.

A leaf spring 114 is held between the outer cap member 101 and the inner cap member 107 in such a manner that the leaf spring 114 can rotate against the outer cap member 101 and the inner cap member 107. A ring shaped sealing member 115 made of resin is provided on the inner surface of the leaf spring so that the sealing member 115 sits on the outer seal portion 204 when the cap 100 is connected with the filler neck 9.

A pressure valve 120 is provided on the inner side of the inner cap member 107 in such a manner that the cap shaped pressure valve 120 faces to the inner cap member 107.

The pressure valve 120 has a bottom plate 121, a side wall portion 123 extending vertically upwardly from the outer periphery of the bottom plate 121, a flat portion 125 extending radially outwardly from the end portion of the side wall portion 123, a flange portion 127 upwardly from the outer periphery of the flat portion 125, and a hook portion 129 extending radially outwardly from the end portion of the flange portion 127.

The outer diameter of the bottom plate 121 and the side wall portion 123 is smaller than the inner diameter of the inner tubular member 201, and the bottom plate 121 and the side wall portion 123 are disposed within the inner tubular member 201.

The outer diameter of the flat portion 125 is larger than the outer diameter of the inner tubular member 201 and a ring shaped sealing member 131 made of resin is fixed on the lower side of the flat portion 121 so that the sealing member 131 sits on the inner sealing portion 202.

The outer diameter of the flange portion 127 is slightly smaller than the inner diameter of the convex portion 111 of the inner cap member 107 and the outer diameter of the hook portion 129 is slightly smaller than the inner diameter of the side wall portion 109 of the inner cap member so that the flange portion 127 and the hook portion 129 are disposed inside of the side wall portion 102 of the inner cap member 107 and that the pressure valve 120 can move vertically along with the side wall portion 109 of the inner cap member 107. The pressure valve 120 is connected with the inner cap member in such manner that the hook portion 129 is hooked by the concave portion 111.

A penetrating hole 150 is provided at the center of the bottom plate 121 and a center wall 133 is provided in the end plate 121 of the inner cap member 107 so that the center wall 133 forms the connecting hole 150 therein. The sectional area of the connecting hole 150 decreases around an axis of the center rod from the lower space of the pressure valve to the upper space of the pressure valve.

A plurality of ribs 135 is formed at the flat plate 125, the side wall portion 123, the bottom plate 121 and the center wall 133 in order to increase the mechanical strength of the inner pressure valve 120.

A coil spring 137 is provided between the inner cap member 107 and the pressure valve 120 so that the pressure valve 120 is forced toward the inner tubular member 201. One end of the coil spring 137 is engaged with the inner surface of the inner cap member, and another end of the coil spring is engaged with the upper surface of the bottom plate 121.

A pressure modulating valve 140 is provided at the lower surface of the bottom plate 121. The pressure modulating valve 140 has a flat portion 141 and a center rod 143 extending upwardly from the center of the flat portion 141. A sealing member 147 is provided on the upper surface of the flat portion, and the sectional area of the center rod is reduced at the upper portion thereof so that the gap between the center rod 143 and the center wall 133 is the same distance along the longitudinal line of the center rod 143. A hook plate 145 is connected at the upper end portion of the center rod 143 so that the pressure modulating valve 140 is prevented from dropping from the center wall 133.

A passing area is a passing area which is formed between the outer surface of the center rod 143 and the inner surface of the center wall 133. The passing area is shut when the seal member 147 sits on the under surface of the bottom plate 121, the bottom plate 121 is lifted by the pressure within the upper tank 5. The connecting hole or passing area 150 decreases around the axis of the center rod 143 from the lower space of the pressure valve to the upper space of the pressure valve.

The opening end 51 of the upper tank 5 is inserted into the groove provided at an outer periphery of the end plate 3 via an O-ring 53. The end plate 3 and the upper tank 5 are connected to each other by caulk plate 55 when the caulk plate 55 is caulked onto the edge of the opening end. The lower tank 6 is also connected with the end plate 4 by a caulk plate.

The operation of the radiator cap described above is explained hereinafter. Since the space on the upper side of the pressure valve 120 is connected with the reserve tank through the pipe 10, the pressure within the space is maintained under atmospheric pressure.

The pressure modulating valve 140 moves downwardly in order to open the sealing member 147 from the bottom plate 121 of the pressure valve 120 when the pressure within the upper tank 5 decreases lower than the atmospheric pressure. So that the coolant within the reserve tank is introduced to the upper tank through the pipe 10 and the connecting hole 150 which is provided between the center rod 143 of the pressure modulating pipe 140 and the center wall portion 133.

The pressure modulating valve 140 moves upwardly in order to seal the bottom portion 121 of the pressure valve 120 when the pressure within the upper tank 5 increases higher than the atmospheric pressure. So that the connecting hole 150 is shut by the sealing member 147.

The pressure valve 120 moves upwardly when the pressure in the upper tank 5 increases higher than the predetermined pressure of the coil spring 137. The sealing member 131 moves upwardly with the pressure valve 120 so that the inner seal portion 202 of the inner tubular member 201 is opened and the vaporized coolant within the upper tank 5 escapes to the reserve tank through the groove formed between the outer tubular member 203 and the inner tubular member 201 and the pipe 10. Since the contacting point between the coil spring 137 and the bottom plate 121 of the pressure valve 120 is lower than the contacting point between the sealing member 131 and the inner sealing portion 202, the rotating moment M is generated on the pressure valve 120 in order to make the pressure valve 120 horizontal when the pressure valve 120 inclines and partially opens the inner sealing portion 202. Accordingly, the pressure valve 120 of the present embodiment can be maintained in its horizontal position so that the high pressure vaporized coolant within the upper tank 5 can escape to the groove formed between the inner tubular member 201 and the outer tubular member 203 through the whole circumferential periphery of the inner sealing portion 202. Accordingly, the pressure of the coolant when the coolant escaped the groove can be maintained under the predetermined pressure.

The second embodiment of the present invention is explained hereinafter. The second embodiment of the present invention has a small spring 301 provided between the hook plate 145 and the pressure valve 120 and the center rod 143 of the pressure modulating valve 140 does not vary in sectional area along with the longitudinal axis thereof.

Since the small spring 301 forces the pressure of the modulating valve 140 upwardly, the sealing member 147 is always forced toward the pressure valve 120 by a setting force of the small spring 301. Accordingly, the connecting hole 150 is opened when the pressure within the upper tank decreases so that the pressure forcing the pressure modulating valve 140 downwardly becomes higher than the setting force of the small spring 301.

Every other feature of the second embodiment is the same as those of the first embodiment.

Figure 4:
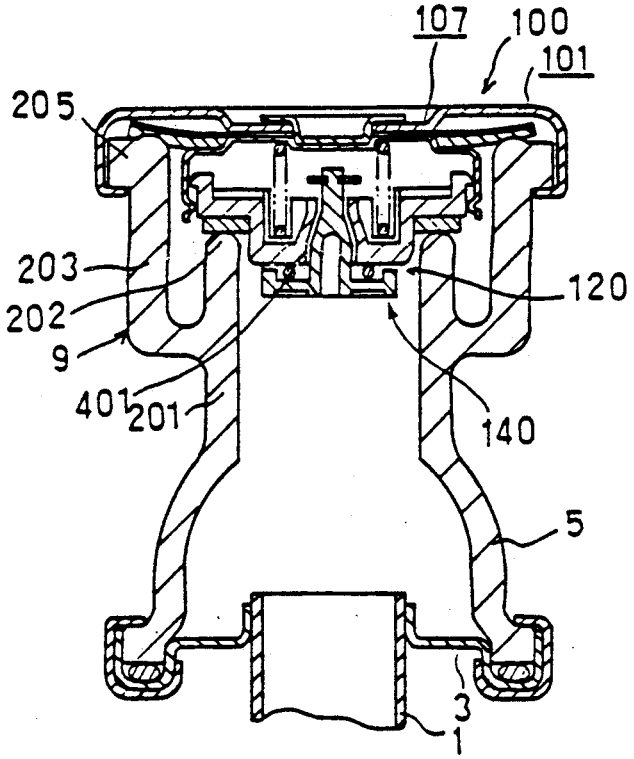
FIG. 4 is a sectional view showing a radiator cap of another species of the second embodiment.
Figure 5:
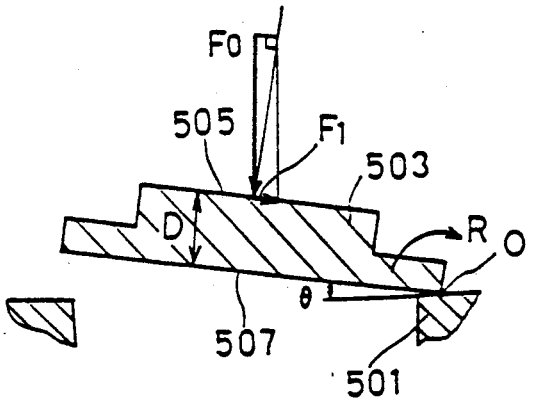
FIG. 5 is a sectional view showing a rotating moment caused by the conventional type of radiator cap.
Figure 6:
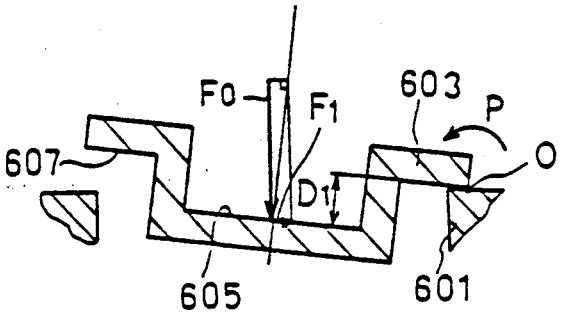
FIG. 6 is a sectional view showing a rotating moment of the radiator cap of the present invention.

Though the sealing member 147 of the pressure modulating valve 140 of the first and second embodiments is a ring shaped, other shaped sealing members such as an O-ring can also be used for the sealing member as described in FIG. 4.

Figure 7:
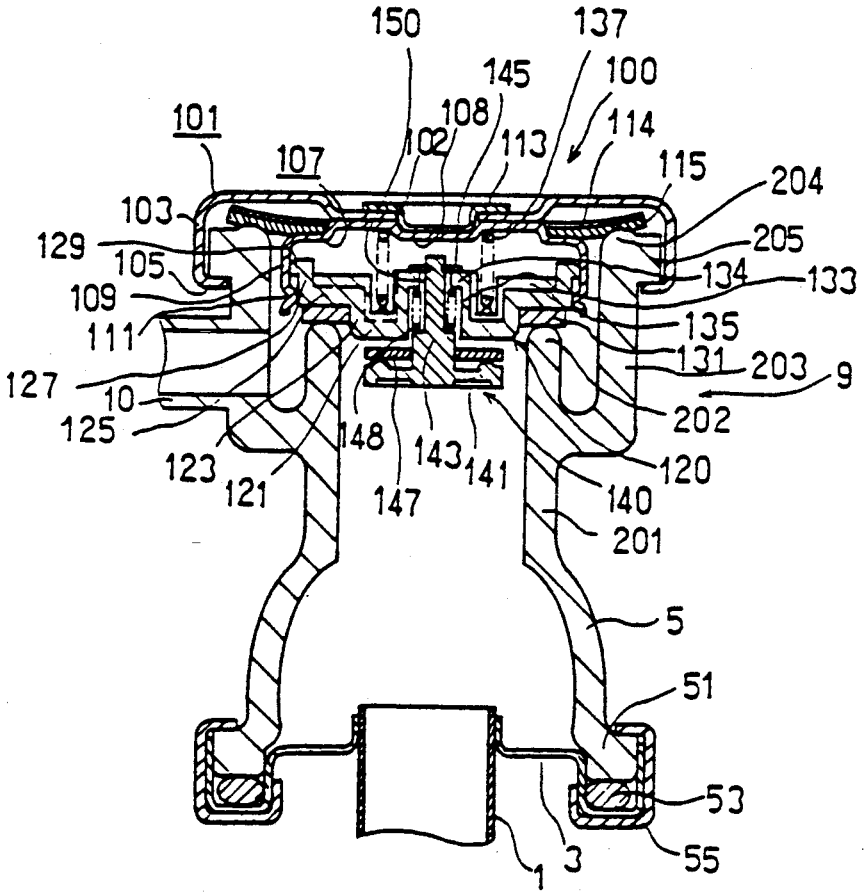
FIG. 7 is a sectional view showing a radiator cap according to the third embodiment.

The third embodiment of the present invention is explained hereinafter with reference to FIG. 7. The center rod 143 of the pressure modulating valve 140 of the third embodiment has a larger diameter rod portion and a smaller diameter rod portion provided at the upper side of the larger diameter rod portion provided. The connecting hole 150 is provided between the outer surface of the smaller diameter rod portion of the center rod 143 and the inner surface of the center wall portion. A spring 148 is provided between the under surface of a hook portion 134 of the center wall 133 and shoulder portion of the center rod portion 143 in order to bias the pressure modulating valve 140 downwardly for opening the connecting hole. Since the setting force of the spring 148 is small, the pressure modulating valve 140 moves upwardly for closing the connecting hole when the pressure within the upper tank 5 increases higher than about 0.4–0.6 kg/cm$^2$. Since a water pump (not shown) which circulates the coolant rotates at a high speed when the engine is under an accelerating or racing condition, the pressure within the upper tank 5 can increase up to about 0.4–0.6 kg/cm$^2$ when the engine is under such a condition. Every other feature of the third embodiment is the same as those of the above described first and second embodiments.

The pressure modulating value 140 of the present invention can open the connecting hole 150 even though the water pump rotates at high speed under the condition when the engine is accelerating or racing. Thus, the pressure modulating valve 140 of the third embodiment can release the coolant within the upper tank 5 to the reserve tank through the connecting tank hole 150 effectively.

The fourth embodiment of the present invention is explained hereinafter with reference to FIG. 8. The pressure modulating valve 140 of the fourth embodiment has the center rod 143 provided within the connecting hole 150, a disk portion provided at the lower end of the center rod 143, and the sealing member 147 provided at the upper end of the disk portion 142 in order to fit the pressure valve 120.

The disk portion 142 of the fourth embodiment is made of bi-metal, the projecting directing of which is changed at the predetermined temperature, and the disk portion 142 is connected with the center rod 143 at the center thereof. The disk portion 142 projects upwardly as shown in FIG. 8 when the temperature within the upper tank 5 is lower than the predetermined temperature so that the connecting hole 150 is opened.

The disk portion 142 projects downwardly when the temperature within the upper tank 5 increases up to the predetermined temperature so that the disk portion 142 forces the sealing member 147 onto the pressure valve 120 in order to close the connecting hole 122. The predetermined temperature is below the boiling point of the coolant within the upper tank 5 such as for example 80° C.–95° C.

A shape memory alloy can be used for the disk portion 142 instead of the bi-metal.

Since the pressure modulating valve of the fourth embodiment employs the disk portion 142, the coolant within the reserve tank can be introduced into the upper tank 5 through the pipe 10 and the connecting hole 150 when the temperature of the coolant within the upper tank 5 is lower than the predetermined temperature (80° C.–95° C.). The connecting hole 150 is closed by the sealing member 147 when the disk portion 142 projects downwardly, namely when the temperature of the coolant within the upper tank 5 increases up to the predetermined temperature (80° C.–95° C.). The coolant within the upper tank 5 can escape when the pressure of the coolant increases higher than the setting force of the coil spring 137.

As described above, since the pressure modulating valve of the fourth embodiment can open the connecting hole whenever the temperature of the coolant within the upper tank 5 is lower than the predetermined temperature, the variation of the pressure within the upper tank can be prevented so that pressure damage to the upper tank 5 can be reduced.

Figure 8:
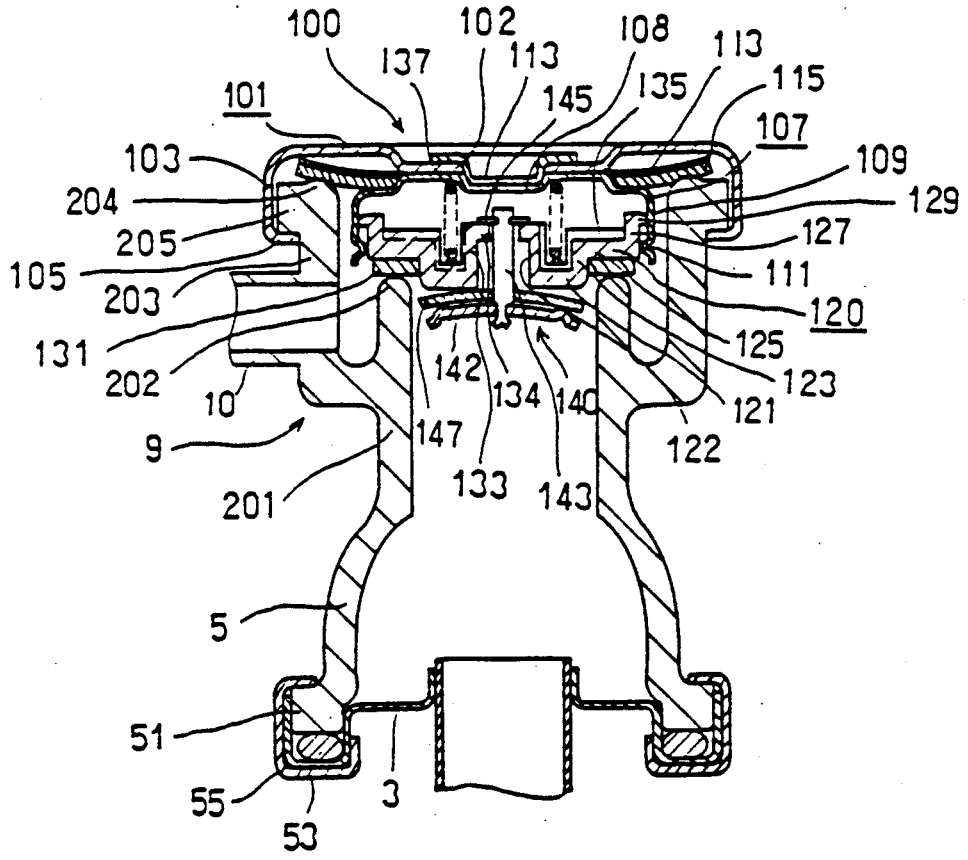
FIG. 8 is a sectional view of a radiator cap according to the fourth embodiment.

Though the disk plate 142 shown in FIG. 8 forces the sealing member 147 against the bottom plate 123 of the pressure valve 120 when the disk plate 142 projects downwardly, the disk plate 142 of the fourth embodiment can have a small gap between the bottom surface of the sealing member 147 even when the disk portion 142 projects downwardly in order to open the connecting hole 150 when the temperature of the coolant within the upper tank 5 increases up to the predetermined temperature (70° C.–80° C.). The connecting hole 150 of the modified embodiment of the fourth embodiment is closed when the pressure within the upper tank 5 increases to higher than the force due to the weight of the pressure modulating valve 140.

Figure 10:
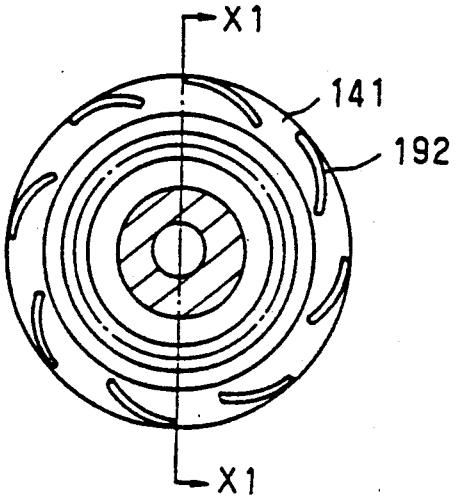
FIG. 10 is a sectional view showing a pressure modulating valve described in FIG. 9.
Figure 11:
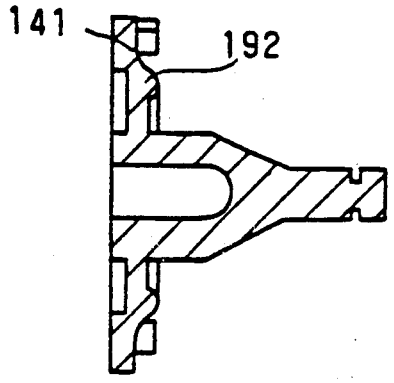
FIG. 11 is a sectional view taken along with X1—X1 line of FIG. 10.
Figure 12:
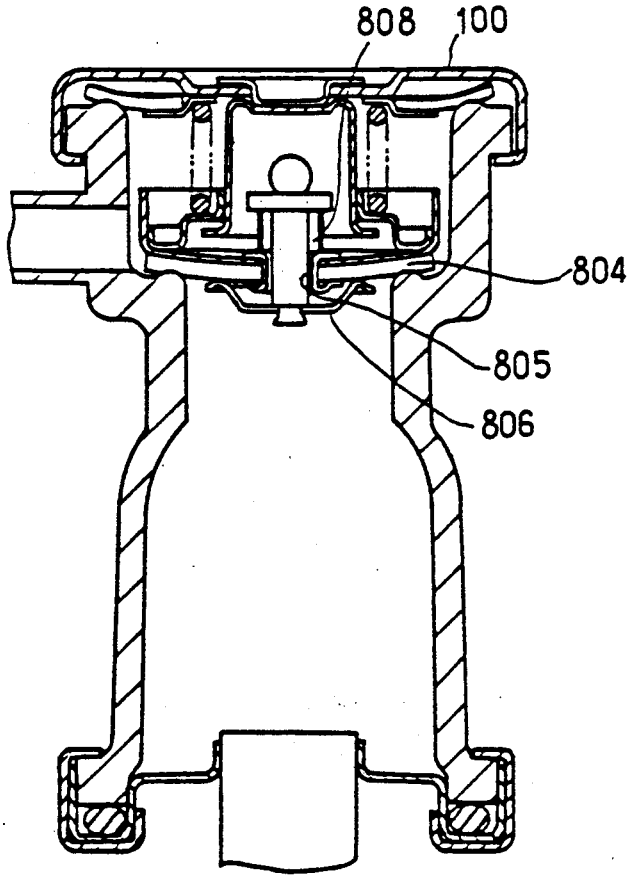
FIG. 12 (PRIOR ART)
FIG. 12 is a sectional view showing a conventional type radiator cap.

The fifth embodiment of the present invention is explained hereinafter with reference to FIG. 9. The pressure modulating valve 140 of the fifth embodiment has the center rod 143 and the flat portion 141 as shown in FIGS. 10 and 11. A plurality of impellers 192 are provided at the upper side of the flat portion 142 so that the impellers 192 make the pressure modulating valve 140 rotate when the flow of the coolant passing through the connecting hole 150 collides therewith.

Figure 9:
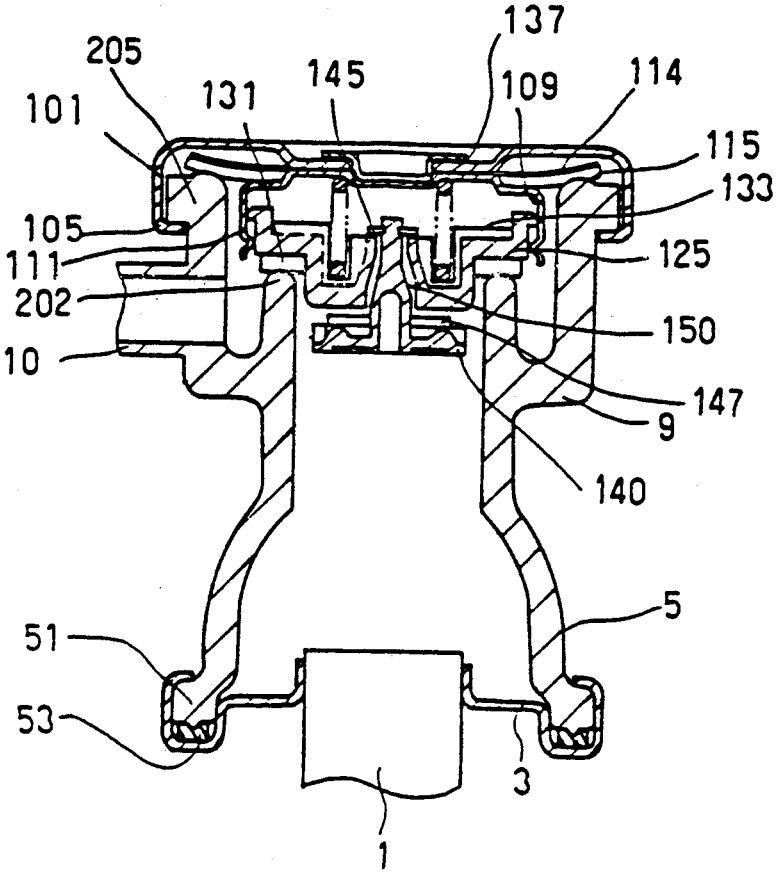
FIG. 9 is a sectional view of a radiator cap according to the fifth embodiment.

The pressure modulating valve 140 moves downwardly under its own weight as shown in FIG. 9 in order to maintain the pressure within the upper tank 5 under the atmospheric pressure when the temperature of the coolant within the upper tank 5 is lower than the predetermined temperature.

The coolant within the upper tank 5 can escape to the reserve tank through the connecting hole 150 and the pipe 10 when the temperature of the coolant increases and the pressure of the tank is also increased. The flow of the coolant passing through the connecting hole 150 makes the pressure modulating valve 140 rotate. The connecting hole 150 is closed by the pressure modulating valve 140 when the pressure attained on the lower surface of the flat portion 141 is greater than the weight of the pressure modulating valve, and the coolant within the upper tank 5 escapes to the reserve tank by lifting the pressure valve 120. The coolant in the reserve tank can return to the upper tank 5 through the connecting tank 150 when the temperature and the pressure of the coolant within the upper tank 5 reduces. The flow of the coolant from the reserve tank to the upper tank 5 also rotates the pressure modulating valve 140.

As a result, the pressure modulating valve 140 of the fifth embodiment can be rotated by both flows of the coolant from the upper tank 5 to the reserve tank and from the reserve tank to the upper tank 5. The rotation of the pressure modulating valve 140 makes it hard for objects to be held between the pressure modulating valve 140 and the pressure valve 120, and also the rotation of the pressure modulating valve 140 and the pressure valve 120.

What is claimed are:

1. An automotive radiator cap for a filler neck of an automotive radiator tank, comprising:

an outer cap member connected to said filler neck;

an inner cap member provided on an inner side of said outer cap member and rotatably connected with said outer cap member;

a first pressure valve operatively coupled to said inner cap member so that said pressure valve can move vertically, said pressure valve facing said inner cap member at one portion of said pressure valve and having a seal portion for sealing said filler neck at an opposite position of said one portion, and having an inner side forming a connecting hole which communicates between an upper space of said pressure valve communicated to a reservoir and a lower space of said pressure valve communicated to said tank;

a pressure modulating valve operatively coupled to said first pressure valve and having a center rod provided in said connecting hole and spaced from said inner side to form a passing area and having sealing means for closing said connecting hole when said pressure modulating valve moves upwardly upon pressure in said tank becoming higher than a predetermined value, said pressure modulating valve operating by virtue of its own weight, when pressure in said tank is below a predetermined value, to open said connecting hole by spacing said sealing means from said connecting hole so as to introduce coolant from said reservoir into said tank;

an outer diameter of said center rod and a diameter of said inner side decreasing around an axis of said center rod from said lower space of said first pressure valve to said upper space of said first pressure valve to cause said passing area of said connecting hole to decrease from said lower space to said upper space; and a coil spring provided between said inner cap member and said first pressure valve so that one end of said coil spring abuts said inner cap member and the other end of said coil spring abuts said first pressure valve toward an opposite direction of said inner cap member, a contacting point between said other end of said coil spring and said first pressure valve being disposed lower than a connecting point between said sealing portion of said first pressure valve and said filler neck.

2. An automotive radiator cap as claimed in claim 1, wherein said seal portion of said first pressure is a sealing member adhesively coupled to a surface of said pressure valve at the side opposite to said inner cap member.

3. An automotive radiator cap claimed in claim 1, further comprising a spring for forcing said pressure modulating valve to open said connecting hole.

4. An automotive radiator cap as claimed in claim 1, wherein said sealing means of said pressure modulating valve is made of thermal reforming material which changes its shape due to the temperature of the coolant within said tank so that said sealing means opens said connecting hole when the temperature of the coolant within said tank is lower than a predetermined temperature and closes said connecting hole when the temperature of the coolant within said tank is higher than a predetermined temperature.

5. An automotive radiator cap according to claim 4, wherein said sealing means of said pressure modulating valve is made of a bi-metal.

6. An automotive radiator cap according to claim 4, wherein said sealing means of said pressure modulating valve is made of a memory shaped alloy.

7. An automotive radiator cap according to claim 1, wherein said sealing means of said pressure modulating valve has a plurality of impellers so that flow passing through said connecting hole rotates said pressure modulating valve.

* * * * *